US008505345B2

(12) United States Patent
Sun et al.

(10) Patent No.: US 8,505,345 B2
(45) Date of Patent: Aug. 13, 2013

(54) DOOR LOCK ASSEMBLY HAVING A PRESS BUTTON IN AN INNER HANDLE

(75) Inventors: Chia-Min Sun, Chia-Yi (TW); Sheen-Youl Gao, Yu-Lin County (TW); Song-Gen Shyu, Chia-Yi Hsien (TW)

(73) Assignee: Spectrum Brands Taiwan, Inc., Taipei (TW)

( * ) Notice: Subject to any disclaimer, the term of this patent is extended or adjusted under 35 U.S.C. 154(b) by 541 days.

(21) Appl. No.: 12/124,340

(22) Filed: May 21, 2008

(65) Prior Publication Data

US 2008/0216528 A1 Sep. 11, 2008

Related U.S. Application Data

(62) Division of application No. 11/299,477, filed on Dec. 12, 2005, now abandoned.

(30) Foreign Application Priority Data

Feb. 21, 2005 (TW) ..... 94202790 U
Apr. 8, 2005 (TW) ..... 94206244 U

(51) Int. Cl.
*E05B 13/10* (2006.01)

(52) U.S. Cl.
USPC ..... 70/224; 70/223; 70/472

(58) Field of Classification Search
USPC ..... 70/220–224, 472–473; 292/336.6, 292/347, DIG. 36
See application file for complete search history.

(56) References Cited

U.S. PATENT DOCUMENTS

| | | | | |
|---|---|---|---|---|
| 2,998,274 | A * | 8/1961 | Russell | 292/169.17 |
| 4,201,069 | A * | 5/1980 | Katayama et al. | 70/422 |
| 4,966,399 | A * | 10/1990 | Lin | 292/359 |
| 5,301,526 | A * | 4/1994 | Fann et al. | 70/224 |
| 5,816,086 | A * | 10/1998 | Russell, IV | 70/422 |
| 5,904,232 | A * | 5/1999 | Shen | 192/69.62 |
| 5,941,108 | A * | 8/1999 | Shen | 70/467 |
| 6,099,053 | A * | 8/2000 | Huang | 292/336.3 |
| 6,470,721 | B2 * | 10/2002 | Ming | 70/224 |
| 6,623,053 | B1 * | 9/2003 | Hwang | 292/336.3 |
| 6,742,367 | B2 * | 6/2004 | Wu | 70/224 |
| 6,860,529 | B2 * | 3/2005 | Chong et al. | 292/169.18 |
| 7,100,407 | B2 * | 9/2006 | Chen | 70/224 |
| 7,178,842 | B2 * | 2/2007 | Wheatland | 292/336.3 |
| 2008/0216528 | A1 * | 9/2008 | Sun et al. | 70/224 |

* cited by examiner

*Primary Examiner* — Kristina Fulton
(74) *Attorney, Agent, or Firm* — Chun-Ming Shih

(57) ABSTRACT

A door lock assembly includes a press button disposed within an inner drive tube and an inner handle. A cam mechanism is provided to associate with the press button and the inner drive tube to rotate the press button when the press button is pressed axially. The cam mechanism includes an inclined cam groove/slot which is formed in one of the inner drive tube and the press button and which extends substantially in a helical direction, and a cam protrusion formed on the other one of the inner drive tube and the press button and extending into the cam groove/slot. A press button rod is connected to the press button for simultaneous rotation with the press button.

16 Claims, 13 Drawing Sheets

DOOR LOCK ASSEMBLY HAVING A PRESS BUTTON IN AN INNER HANDLE

CROSS-REFERENCE TO RELATED APPLICATIONS

This application claims priority from Taiwanese Utility Model Application Nos. 094202790 and 094206244 filed on Feb. 21, 2005 and Apr. 8, 2005, respectively.

BACKGROUND OF THE INVENTION

1. Field of the Invention

This invention relates to a door lock assembly, more particularly to a door lock assembly which includes an inner handle provided with a press button.

2. Description of the Related Art

FIG. 1 shows a door lock assembly which is disclosed in U.S. Pat. No. 5,301,526. The outside lock unit of the door lock assembly includes an outer handle (E') and an outer drive tube (C') The outer drive tube (C') has one end inserted into the outer handle (E'). A key-operated lock (C') is mounted inside the outer handle (E') and the outer drive tube (C'). The inside lock unit includes an inner handle (H') and an inner drive tube (I') inserted into the inner handle (H'). A rotary button (F') is disposed inside a space defined by the inner handle (H') and the inner drive tube (I'). A latch-operating tube 1 is connected between the inner and outer handles (H') and (E') for latching or unlatching a door latch (not shown).

The latch-operating tube 1 has a tubular member of rectangular cross-section and has an enlarged base (not shown) which has a push protrusion (not shown). The latch-operating tube 1 is inserted into the inner drive tube (I'), whereas the enlarged base thereof extends into the outer drive tube (C'). A limit plate (2*e*) is mounted inside the outer drive tube (C') and is formed with a slot (not shown). A rotary button rod 3 has one end connected to the key-operated lock (G') and the other end extending into the rotary button (F'). The rotary button rod 3 extends through the limit plate (2*e*) and the latch-operating tube 1 between the key-operated lock (G') and the rotary button (F').

When the rotary button (F') is turned, the rotary button rod 3 pushes the limit plate (2*e*) to project outwardly from the outer drive tube (C') so that the door lock assembly is in a locked state. The door lock assembly is placed in an unlocked state when the key-operated lock (G') is unlocked using a key to turn the rotary button rod 3 so that the limit plate (2*e*) is moved inward, or when the inner handle (H') is rotated to turn the latch-operating tube 1 so as to push the limit plate (2*e*) inward and to thereby turn the rotary button rod 3. Such a door lock assembly tends to cause inconveniences to a handicap as it is necessary to rotate the rotary button (F').

Door lock assemblies having an inner lock unit provided with a press button have existed in the prior art. Examples of such door lock assemblies are disclosed in U.S. Pat. Nos. 5,816,086 and 6,623,053. However, while the press buttons disclosed therein can be operated through a pressing action, the constructions thereof are complicated.

SUMMARY OF THE INVENTION

An object of the present invention is to provide a door lock assembly having an inner handle provided with a press button which is simple in construction and which can be operated through a pressing action.

According to this invention, a door lock assembly comprises an inner handle, an inner drive tube inserted into the inner handle and engaging the inner handle for simultaneous rotation therewith, a press button disposed within the inner drive tube and the inner handle and including an outer press end exposed from the inner handle; a cam mechanism; and a press button rod.

The cam mechanism is associated with the press button and the inner drive tube to rotate the press button when the outer press end is pressed axially. The cam mechanism includes an inclined cam groove/slot which is formed in one of the inner drive tube and the press button and which extends substantially in a helical direction, and a cam protrusion formed on the other one of the inner drive tube and the press button and extending into the cam groove/slot.

The press button rod extends into the inner drive tube and has one end portion connected to the press button for simultaneous rotation with the press button.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
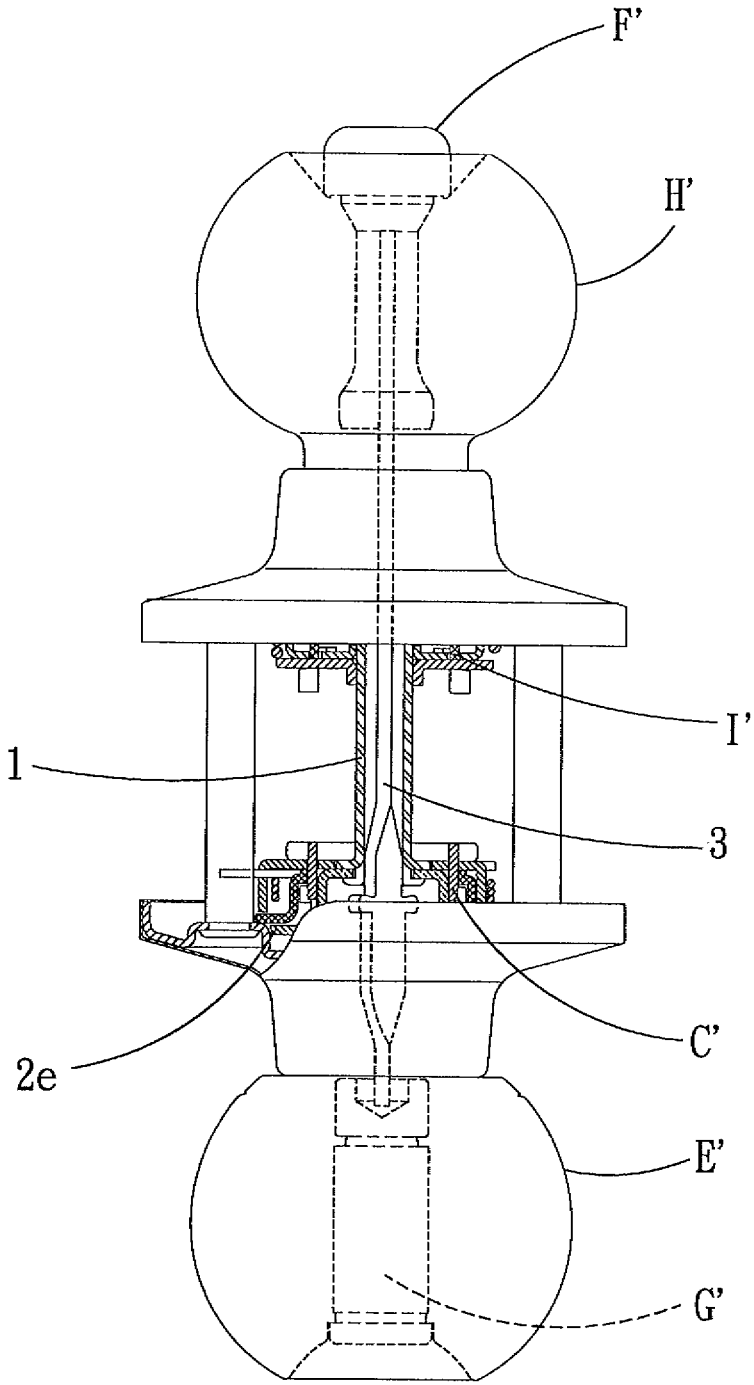
FIG. 1 PRIOR ART
FIG. 1 shows a conventional door lock assembly.

Before the present invention is described in greater detail, it should be noted that same reference numerals have been used to denote like elements throughout the specification.

Figure 2:
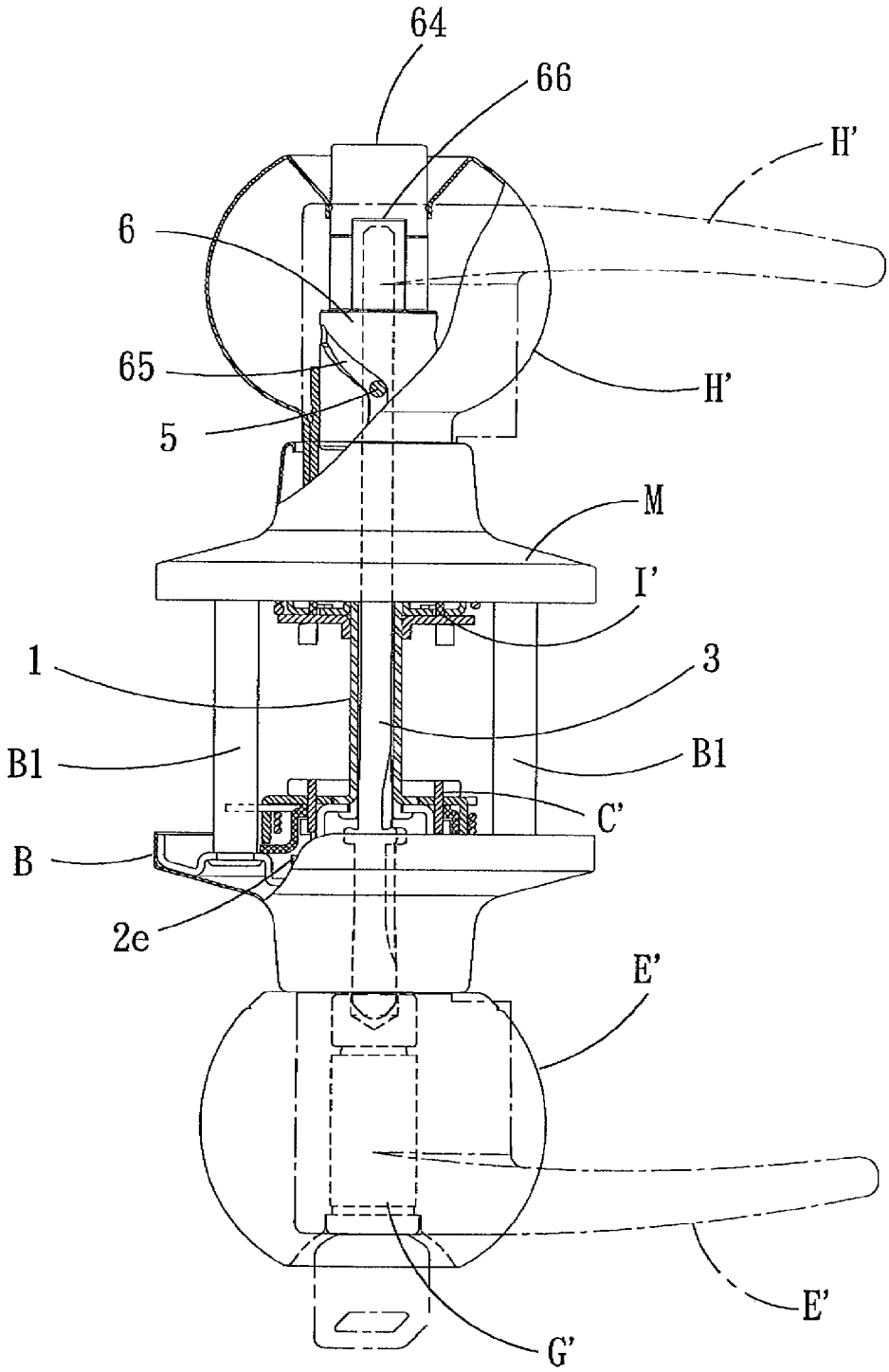
FIG. 2 is a partly sectioned view of a door lock assembly according to a preferred embodiment of the present invention.
Figure 3:
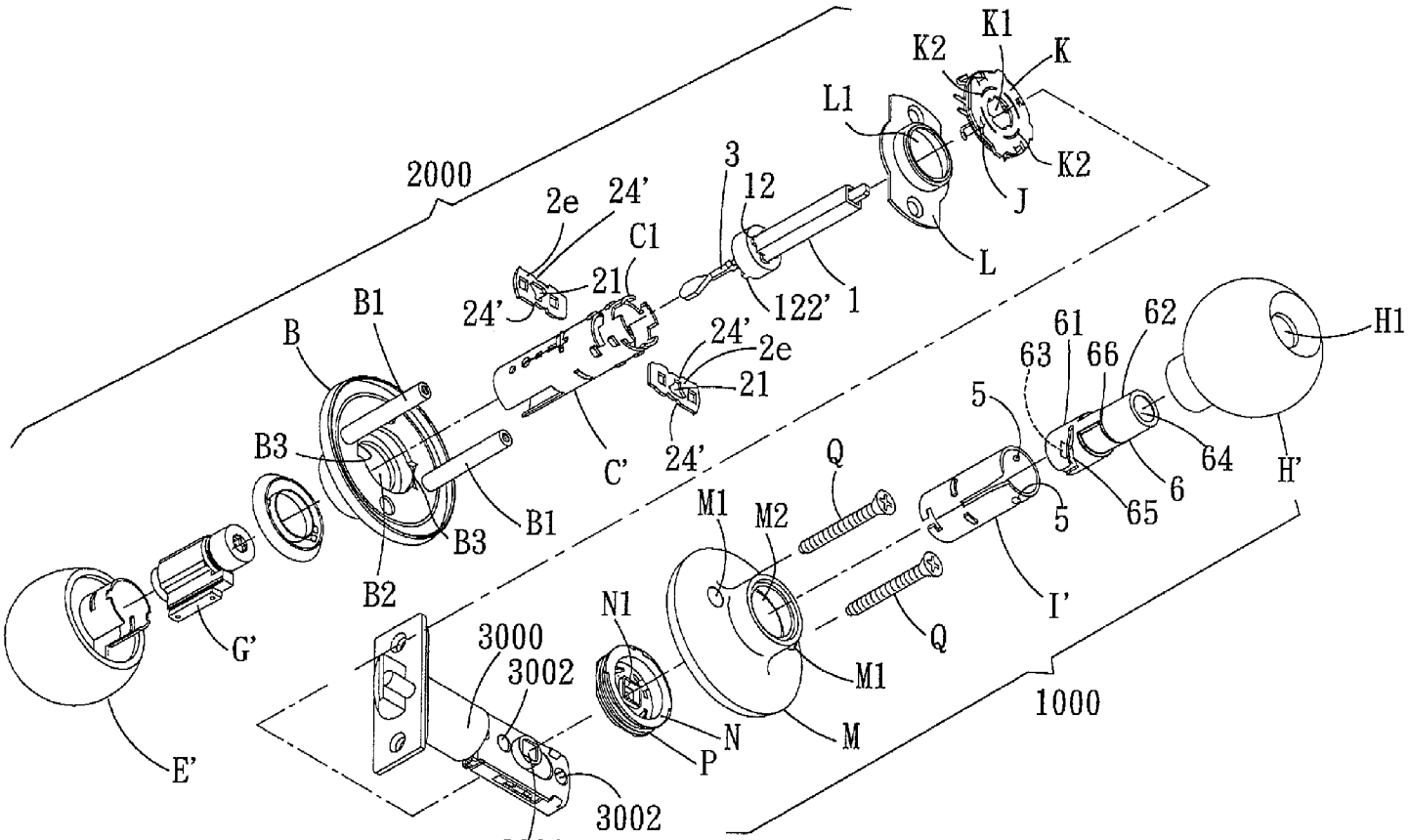
FIG. 3 is an exploded view of the door lock assembly of FIG. 2.

Referring to FIGS. 2 and 3, a door lock assembly according to a preferred embodiment of the present invention is shown to include an inside lock unit 1000, an outside lock unit 2000 and a latch mechanism 3000. The door lock assembly can be installed on a door in a conventional manner.

The latch mechanism 3000 is disposed between the inside and outside lock units 1000 and 2000 and includes two through holes 3002 and a cam hole 3001 between the through holes 3002.

The outside lock unit 2000 includes an outer disc (B) which is provided with two threaded tubes (B1) and a central hole (B2). The threaded tubes (B1) are provided respectively with internal screw threads and are used to extend through the through holes 3002 of the latch mechanism 3000, respectively. An outer rotary seat (L) is assembled with the outer disc (B) in a conventional manner and includes a central hole (L1). An outer handle (E') is assembled with an outer drive tube (C') in a known manner. While the outer handle (E') is in the form of a knob in this embodiment, it may be configured as a handle lever as shown in the dotted lines in FIG. 2. The outer drive tube (C') extends through the central hole (B2) of the outer disc (B) and the central hole (L1) of the outer rotary seat (L) and has one end connected to the outer handle (E'). A key-operated lock (G') is mounted inside a space defined by the outer handle (E') and the outer drive tube (C').

The outer drive tube (C') is further connected to an outer rotary plate (K) through the interengagement of flanges (C1) and slots (K2). The threaded tubes (B1) further extend through the outer rotary seat (L) and the outer rotary plate (K). A spring coil (J) is supported by the outer rotary plate (K) in a known manner and has two legs (not shown) abutting respectively against the threaded tubes (B1) of the outer disc (B).

The inside lock unit 1000 includes an inner disc (M) which has two openings (M1) and a central hole (M2). Two fastening screws (Q) are inserted respectively through the openings (M1) and are engaged threadedly with the respective threaded tubes (B1) of the outer disc (B). Through the interengagement of the fastening screws (Q) and the threaded tubes (B), the inner and outer discs (M) and (B) can be mounted respectively on inner and outer sides of a door panel (not shown).

The inside lock unit 1000 further includes an inner handle (H') which is formed as a knob in this embodiment. Alternatively, the inner handle (H') may be configured as a handle lever as shown in the dotted lines in FIG. 2. An axial through hole (H1) is provided in the inner handle (H'). An inner drive tube (I') passes through the central hole (M2) of the inner disc (M) and extends into the axial through hole (H1) to connect with the inner handle (H') in a conventional manner so that the inner drive tube (I') is rotatable along with the inner handle (H'). An inner rotary plate (N) which supports a spring coil (P) is connected to the inner drive tube (I') opposite to the inner handle (H').

The door lock assembly further includes a latch-operating tube 1 of rectangular cross-section, which has an enlarged base 12 extending into the outer drive tube (C'). Two push protrusions 122' (only one is shown) project axially from the enlarged base 12. The latch-operating tube 1 passes through the central hole (K1) of the outer rotary plate (K), the cam hole 3001 of the latch mechanism 3000, and a central hole (N1) of the inner rotary plate (N) and is rotatable along with the inner handle (H'). Two limit plates (2*e*) are mounted transversely inside the outer drive tube (C') and are movable between a locking position in which the limit plates (2*e*) project out from the outer drive tube (C') to engage notches (B3) of the outer disc (B) and an unlocking position in which the limit plates (2*e*) retract into the outer drive tube (C'). Each limit plate (2*e*) has a central hole 21 and two inclined faces 24'. The limit plates (2*e*) are known. When the inclined faces 24' of the limit plates (2*e*) are pushed by the respective push protrusion 122' of the enlarged base 12, the limit plates (2*e*) can be moved to the unlocking position. While two limit plates (2*e*) are provided in this embodiment to be actuated respectively by the two push protrusions 122', the present invention may also be embodied by using only one limit plate (2*e*) and one push protrusion 122'.

A press button rod 3 extends through the latch-operating tube 1 and the central holes 21 of the limit plates (2*e*) and has one end inserted into a slot (not shown) of the key-operated lock (G') and the other end connected to a press button 6.

Figure 7:
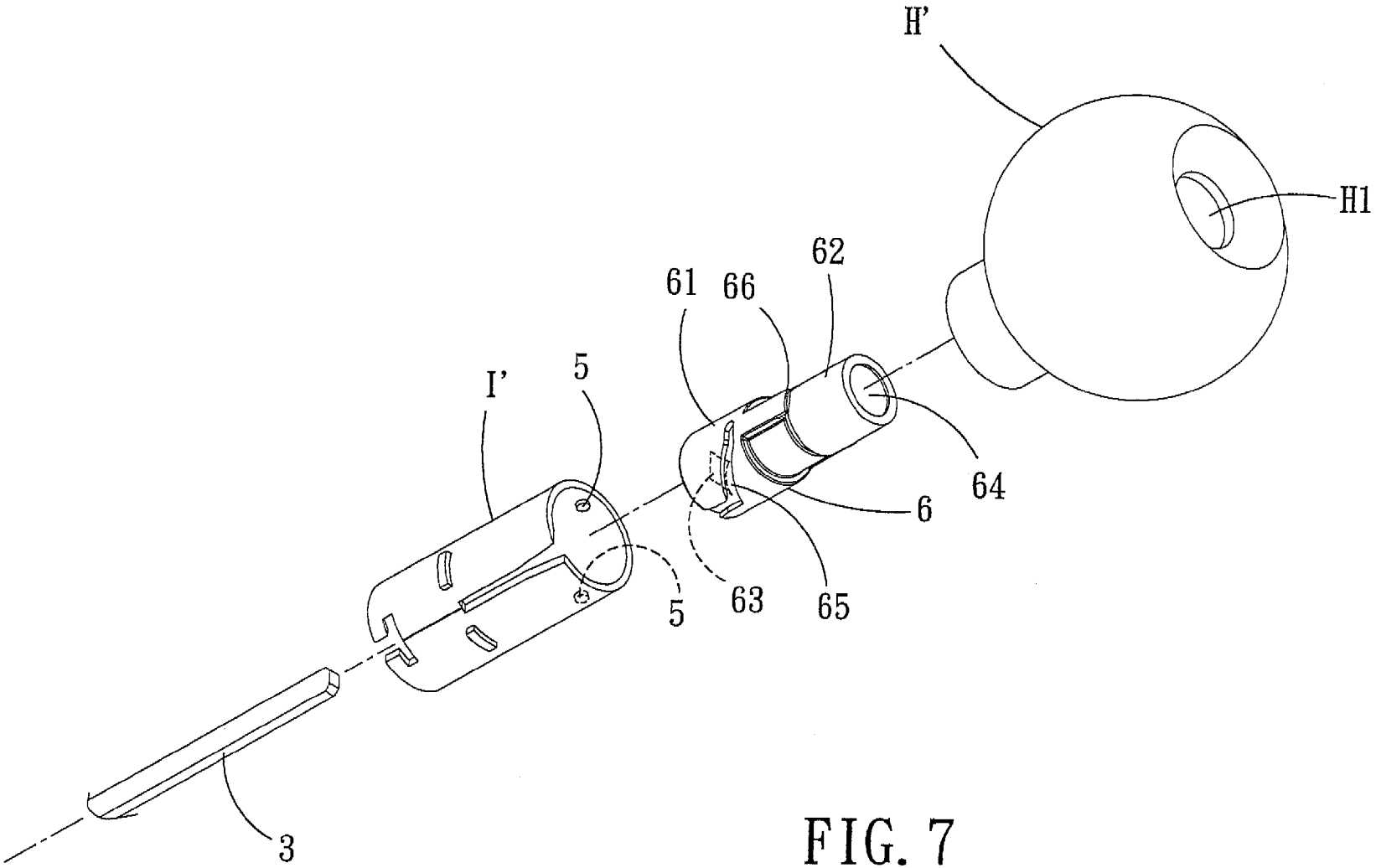
FIG. 7 is an exploded view of the inner lock unit of FIG. 5.
Figure 8:
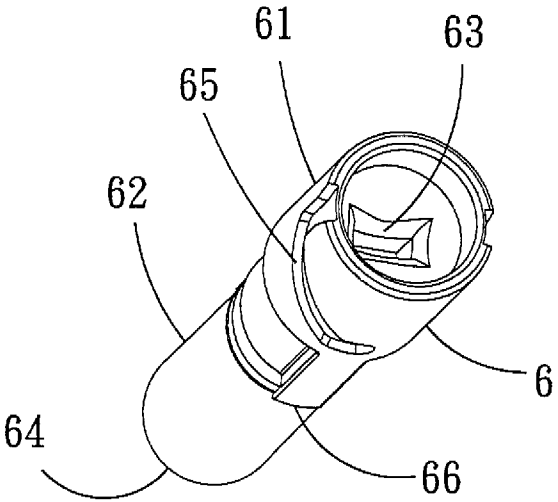
FIG. 8 is a perspective view of the press button of the inner lock unit.

According to the present invention, the inner drive tube (I') is provided with two cam protrusions 5 which projects inwardly from an inner surface of the inner drive tube (I') proximate to one end of the inner drive tube (I') extending into the inner handle (H'). The press button 6 includes a first tubular section 61 and a second tubular section 62, as best shown in FIGS. 7 and 8. The first tubular section 61 is inserted into the inner drive tube (I') and has an axial engaging hole 63 for insertion of the press button rod 3. The cross-section of the axial engaging hole 63 is substantially rectangular and similar to that of the press button rod 3 so that the press button rod 3 is rotatable along with the press button 6. The second tubular section 62 has an outer press end 64. The first tubular section 61 further includes a pair of cam grooves 65 formed in an outer surface of the first tubular section 61 to receive slidably the cam protrusions 5, respectively. The cam grooves 65 extend substantially in helical directions. The press button 6 further includes shoulder faces 66 between the first and second tubular sections 61, 62 for abutment against an inner edge of the axial through hole (H1) of the inner handle (H') so that the outward movement of the first tubular section 61 is prevented and so that only the second tubular section 62 can protrude outwardly from the axial through hole (H1) when the press button 6 is not depressed.

Figure 9:
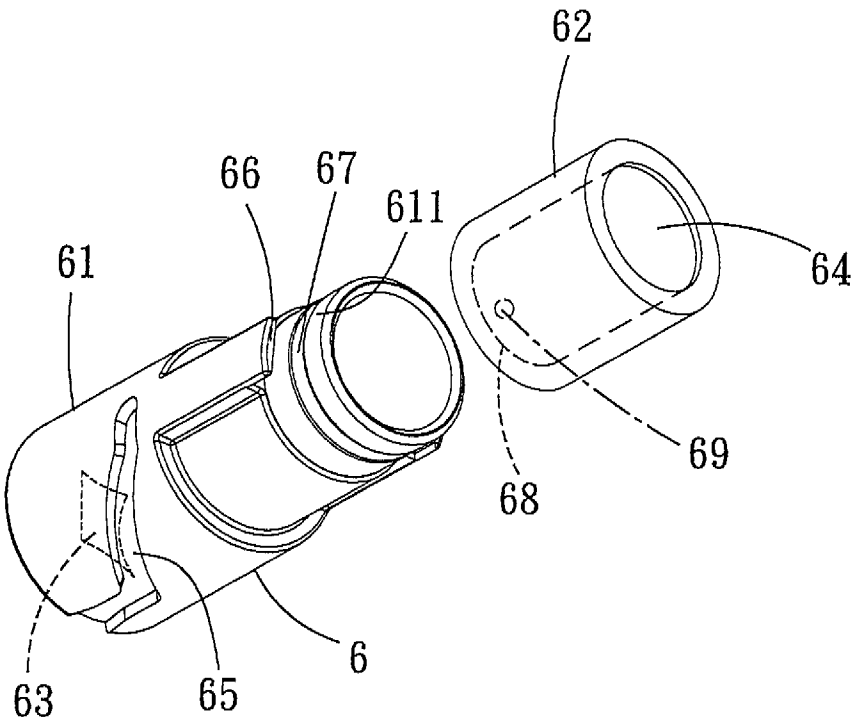
FIG. 9 is an exploded view of a press button having a multi-component structure.
Figure 10:
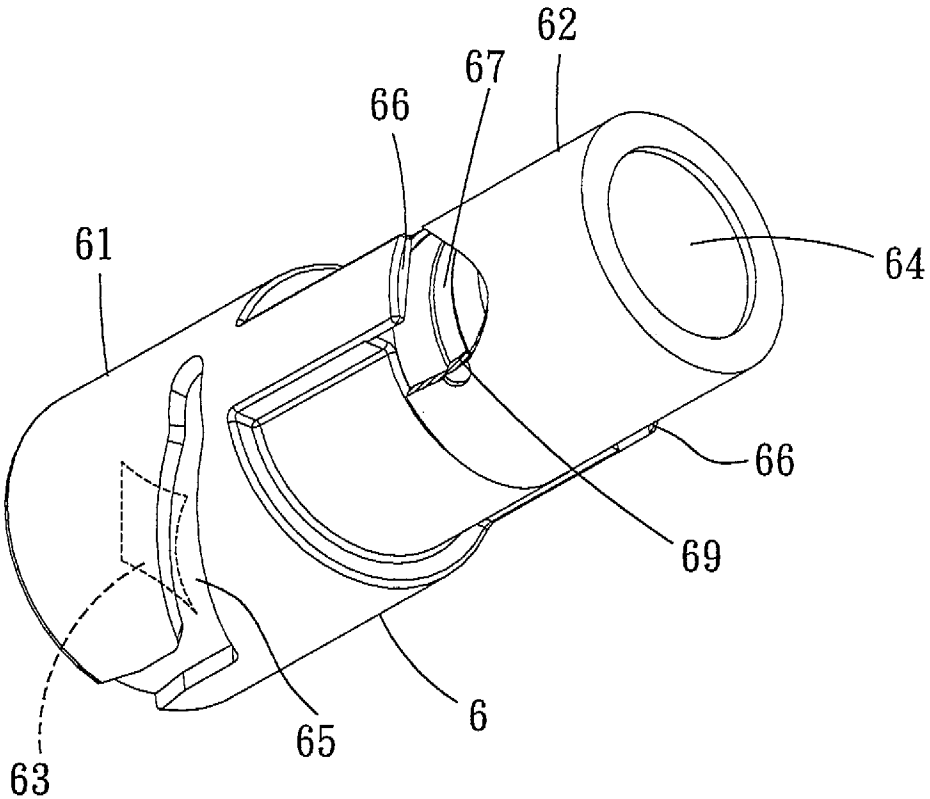
FIG. 10 is a perspective view of the press button of FIG. 9.

The press button 6 of the present invention may be a one-piece structure, or a multi-component structure. The press button 6 may be made of a plastic material or a metal. The metal may be formed by casting or press forming. Referring to FIGS. 9 and 10, the press button 6 is a multi-component structure in which the first tubular section 61 and the second tubular section 62 are formed as two separate pieces. The first tubular section 61 is provided with the axial engaging hole 63, and a pair of the cam grooves 65. The first tubular section 61 further includes an insert portion 611 which is provided with an annular groove 67. The shoulder faces 66 are formed on two diametrically opposite sides of the first tubular section 61 and adjacent to the second tubular section 62. The second tubular section 62 is hollow and includes an outer press end 64 and a hole 68 so that the second tubular section 62 can be sleeved rotatably around the insert portion 611. After the second tubular section 62 is sleeved onto the insert portion 611, by using a tool, the second tubular section 62 is crimped at a position corresponding to the annular groove 67 in such a manner that parts of the second tubular section 62 are pressed into the annular groove 67 to form engaging elements 69. The engaging elements 69 engage slidably the annular groove 67 so that the first tubular section 61 is rotatable relative to the second tubular section 62, but is not releasable from the second tubular section 62 in an axial direction, as shown in FIG. 10.

Figure 4:
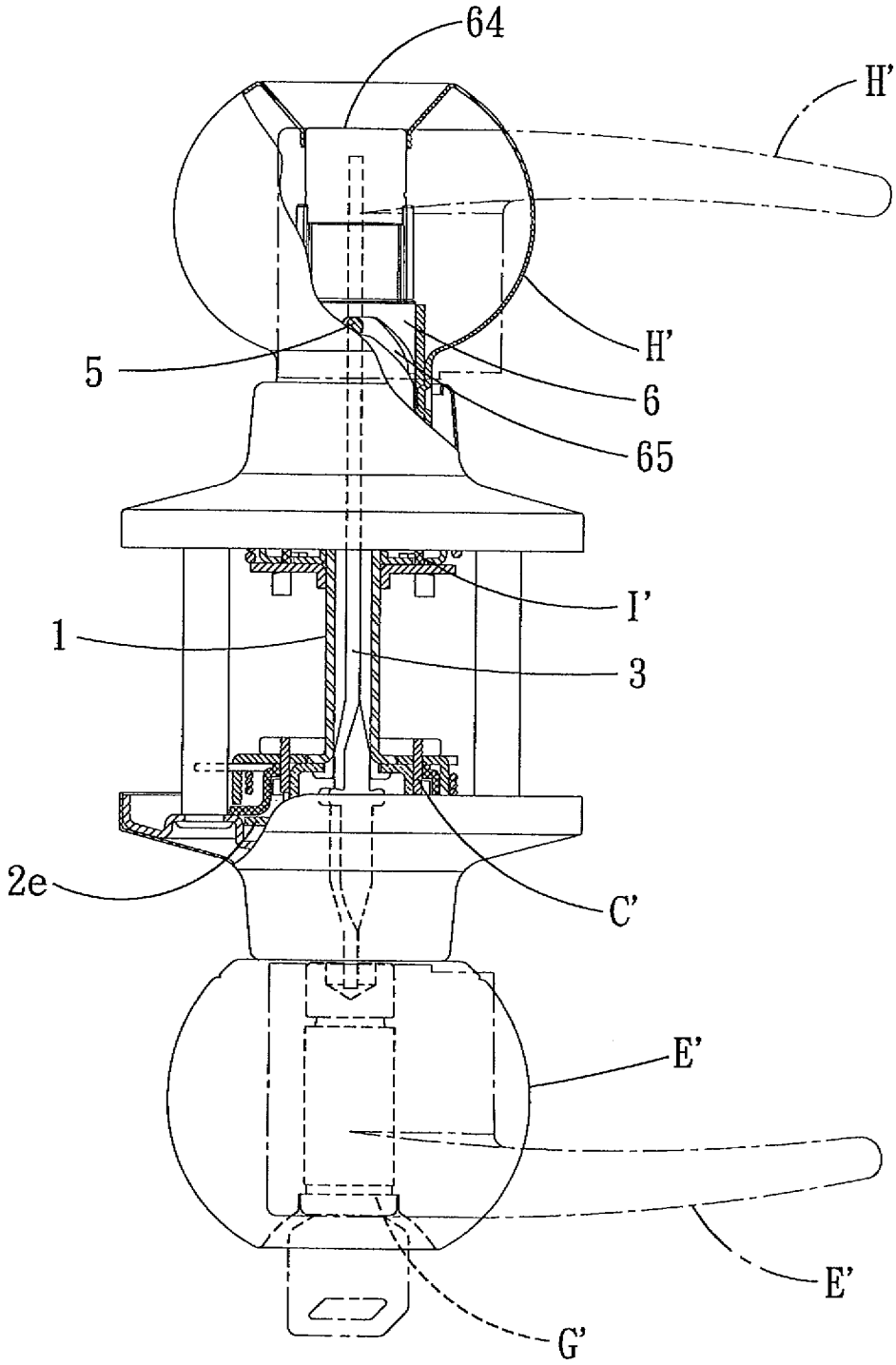
FIG. 4 is the same view as FIG. 2, but with a press button being pressed.
Figure 5:
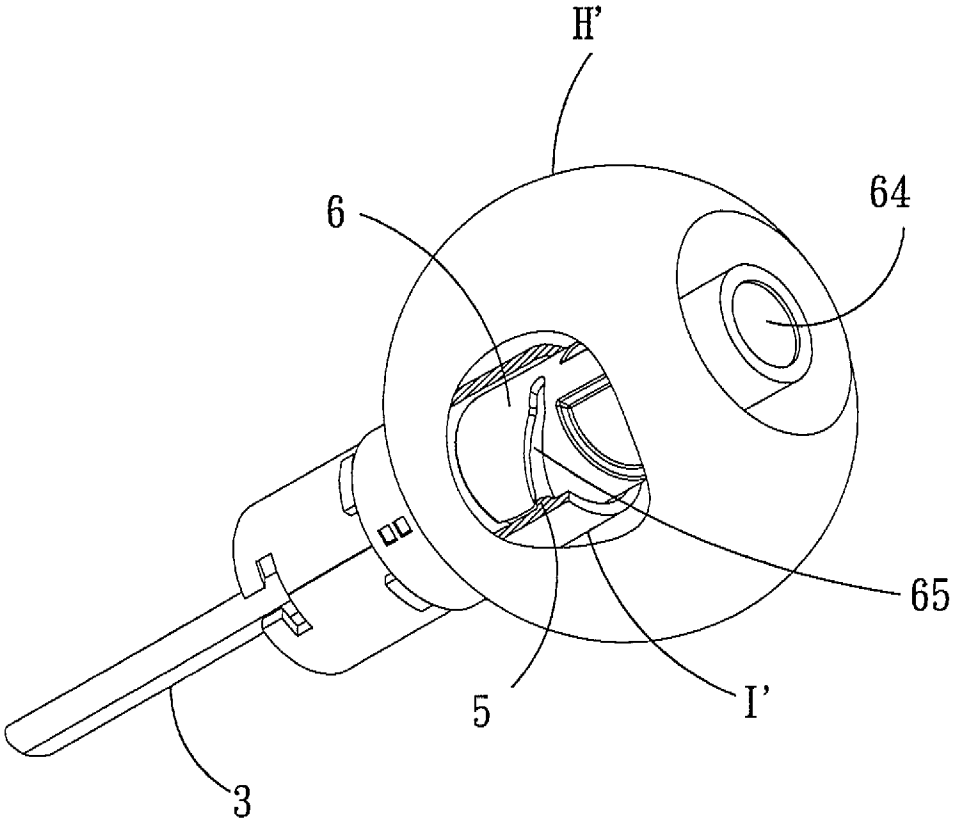
FIG. 5 is a perspective view showing an inner lock unit of the door lock assembly of FIG. 2.
Figure 6:
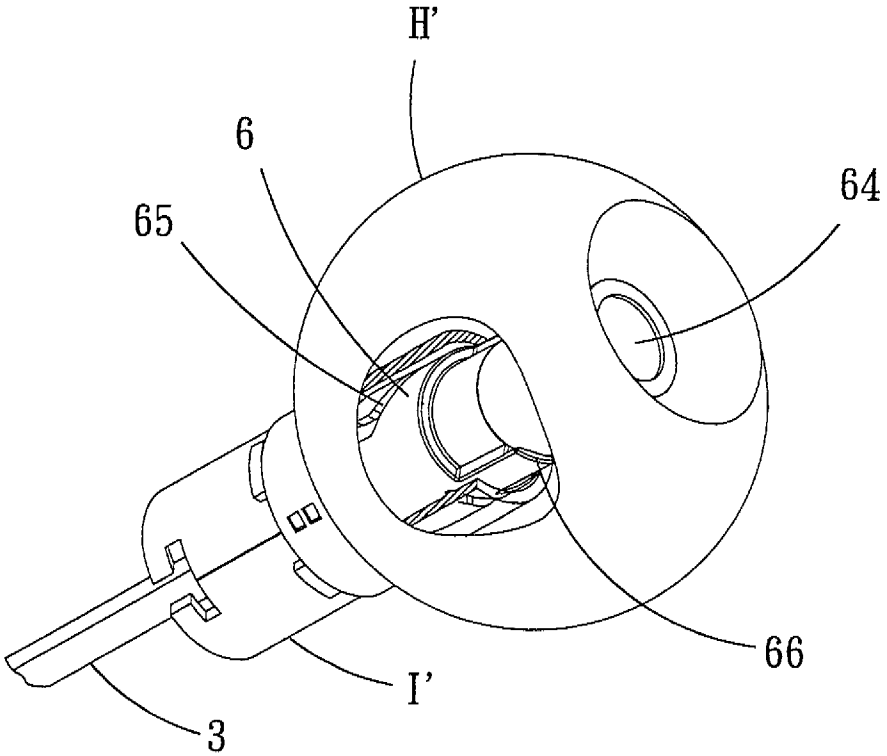
FIG. 6 is the same view as FIG. 5, but with the press button being pressed.

Referring to FIG. 5 in combination with FIGS. 2 and 3, the press button rod 3 which extends from the key-operated lock (G') to the press button 6 and which passes through the limit plates 2*e* and the latch-operating tube 1, has one end inserted into the axial engaging hole 63 of the press button 6. When the outer press end 64 of the press button 6 is pressed to move from a first position (see FIG. 2 or 5) to a second position (see FIG. 4 or 6), the press button 6 moves axially and rotates simultaneously due to the interaction of the cam grooves 65 of the first tubular sections 61 and the cam protrusions 5 of the inner drive tube (I'). As a result, the press button rod 3 rotates along with the press button 6 and actuates the limit plates (2*e*) so that the limit plates (2*e*) project outwardly from the outer drive tube (C') to the locking position and engage the notches (B3) of the outer disc (B), thereby placing the door lock assembly in a locked position.

When the inner handle (H') is rotated, the inner drive tube (I'), the inner rotary plate (N), the latch-operating tube 1 are turned simultaneously so that the push protrusions 122' of the latch-operating tube 1 push inclined faces 24' of the respective limit plates (2*e*). When the limit plates (2*e*) are pushed, the limit plates (2*e*) retract into the outer drive tube (C') and at the same time rotate the press button rod 3 through the central holes 21 thereof, thereby placing the door lock assembly in an unlocked position.

While the cam grooves 65 are provided in the press button 6 in the above-described embodiment, the present invention should not be limited only thereto. According to the present invention, cam slots may be used in place of the cam grooves 65. Furthermore, one or more cam grooves may be provided in the inner drive tube (I') and one or more cam protrusions 5 may be provided on the press button 6. In addition, a spring (not shown) may be provided within the inner drive tube (I') between the press button 6 and the inner rotary plate (N) so as to enhance the returning action of the press button 6. Note that, without the use of such a spring, the press button 6 is also movable to return to its normal position by the action of the spring coil (p) after the inner handle (H') is rotated.

Figure 11:
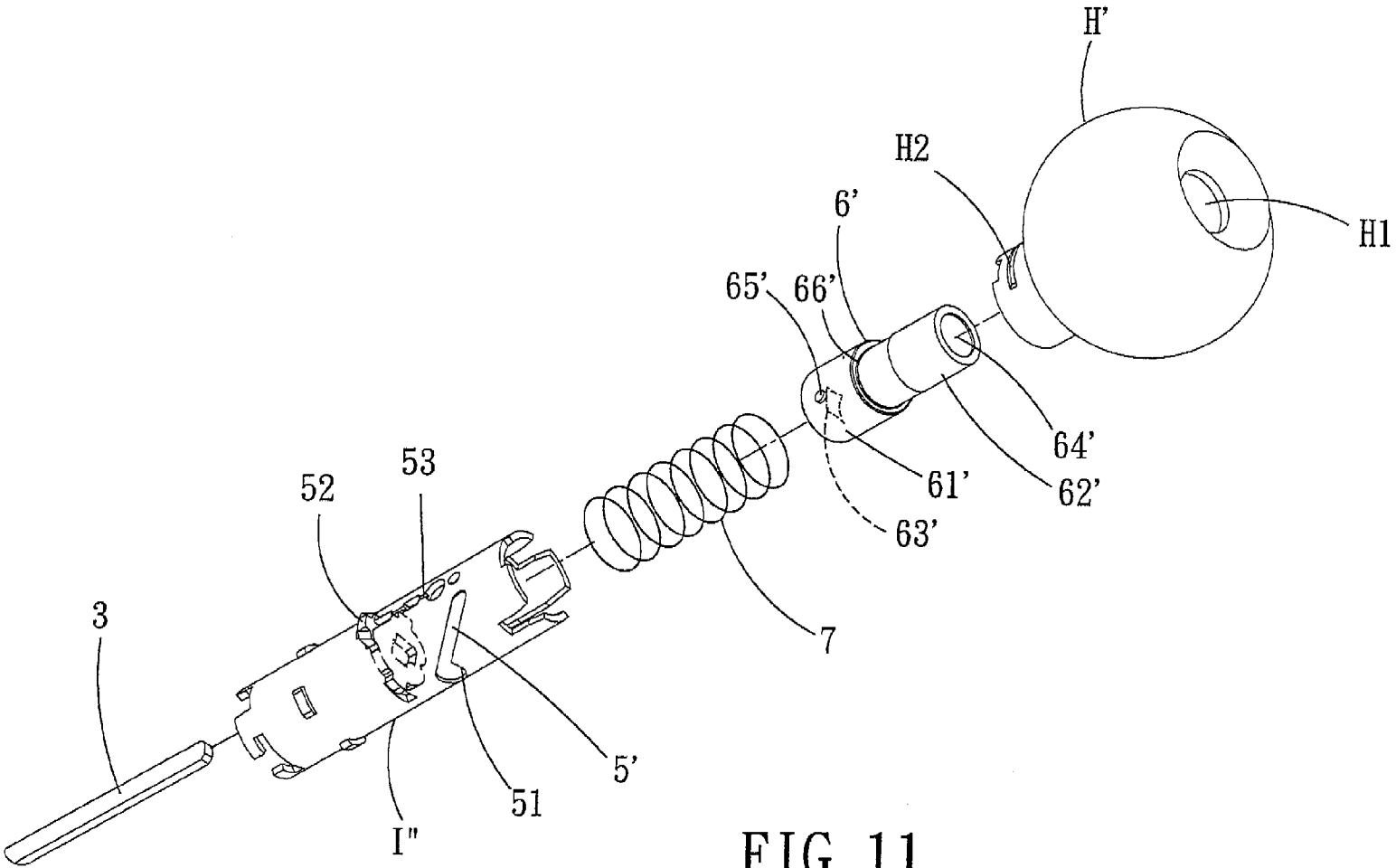
FIG. 11 is an exploded view of an inner lock unit of the door lock assembly according to another preferred embodiment of the present invention.
Figure 12:
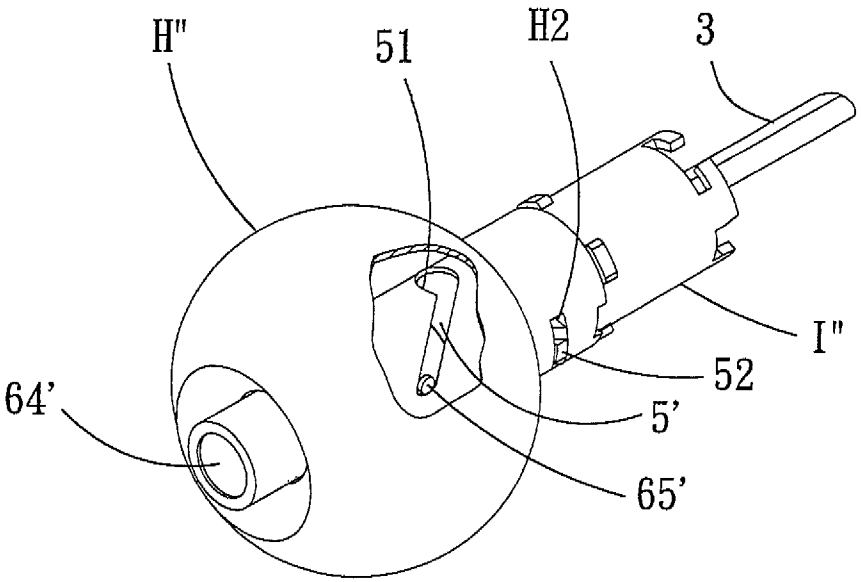
FIG. 12 is a perspective view of the inner lock unit of FIG. 11.
Figure 13:
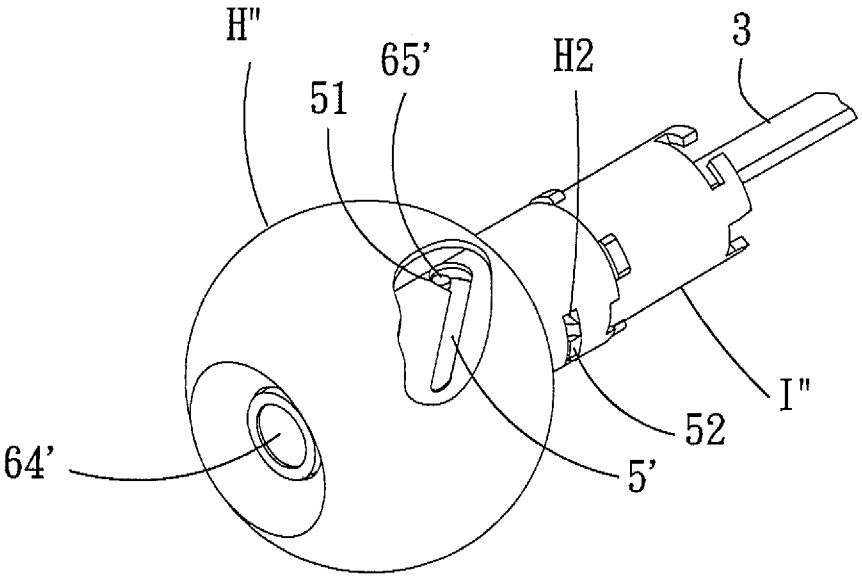
FIG. 13 is the same view as FIG. 12 but with the press button being pressed.

Referring to FIGS. 11 to 13, according to another preferred embodiment of the present invention, an inner drive tube (I") is formed with two inclined cam grooves 5' (only one is shown) proximate to an end of the inner drive tube (I") which is inserted into the inner handle (H'). Each cam groove 5' extends substantially in a helical direction and has a groove end 51 which is turned at an angle with respect to the helical direction.

The press button 6' in this embodiment includes a first tubular section 61', a second tubular section 62', and a shoulder face 66'. The first tubular section 61' extends into the inner drive tube (I") and has an axial engaging hole 63' for insertion of the press button rod 3. The second tubular section 62' has an outer press end 64'. A pair of cam protrusions 65' (only one is shown) project outward from the outer surface of the first tubular section 61' and extend respectively into the cam grooves 5'.

The inner drive tube (I") is further provided with a cross plate 52 which is mounted transversely inside an intermediate part of the inner drive tube (I"), and a resilient steel cable 53 connected to the cross plate 52. Due to the provision of the resilient steel cable 53, the cross plate 52 is movable to retract into or project outwardly from the inner drive tube (I"). When the cross plate 52 projects outwardly of the inner drive tube (I"), it engages a slot (H2) in the inner handle (H').

According to this embodiment, a spring 7 is further provided inside the inner drive tube (I") between the cross plate 52 and the press button 6' to bias the outer press end 64' of the press button 6' to protrude from the inner handle (H'), thereby increasing the returning force of the press button 6'. The use of the spring 7 is optional, and the press button 6' can return to its original position, like the press button 6 which is described hereinbefore.

However, after the press button 6' is pressed to the position shown in FIG. 13, it is easily returned to its original non-pressed position shown in FIG. 12 by the force of the spring 7. Therefore, the groove ends 51 of the cam grooves 5' are provided to retain the respective cam protrusions 65' of the press button 6' so as to prevent the cam protrusions 65' from sliding undesirably along the cam grooves 5' to their original non-pressed position.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

We claim:

1. A door lock assembly comprising:

an inner disc adapted to be fixed to a door;

an inner handle;

a single piece inner drive tube inserted into said inner handle and engaging said inner handle for simultaneous rotation therewith, said inner drive tube extending into said inner disc, and having an outer surface in direct contact with said inner handle;

an inner rotary plate engaging said inner drive tube, and having a central hole;

an outer handle;

an outer drive tube connected to said outer handle;

a latch-operating tube adapted to operate a latch and engaging and passing through said central hole so that rotation of said inner handle can be transmitted to said latch-operating tube through said inner drive tube and said inner rotary plate;

a press button disposed within said inner drive tube and said inner handle;

a press button rod extending into said inner drive tube and having one end portion connected to said press button, said press button rod extending through said latch-operating tube and into said outer drive tube; and a cam mechanism associated with said press button and said inner drive tube to cause said press button rod to rotate when said press button is pressed axially, said cam mechanism including an inclined cam groove/slot which is formed in said inner drive tube and which extends substantially in a helical direction, and a cam protrusion formed on said press button and extending into said cam groove/slot so that when said press button is pressed axially, the cam protrusion is always located within the cam groove/slot, wherein said press button includes a first tubular section and a second tubular section, the cam protrusion is formed in said first tubular section of said press button.

2. The door lock assembly of claim 1, wherein said second tubular section has an outer press end, and said first tubular section further has an axial engaging hole engaging said press button rod so that said press button rod rotates along with said first tubular section.

3. The door lock assembly of claim 2, wherein said press button further includes a shoulder face formed between said first and second tubular sections.

4. The door lock assembly of claim 2, wherein both of said press button rod and said engaging hole have a substantially rectangular cross-section.

5. The door lock assembly of claim 3, wherein said inner handle has an axial through hole receiving said press button, said shoulder face being engageable with an inner edge of said inner handle around said axial through hole to restrict said first tubular section from moving out of said inner handle, said second tubular section being extendable outward from said axial through hole and having said outer press end.

6. The door lock assembly of claim 1, wherein said latch-operating tube has a substantially rectangular cross-section and includes an end formed with an enlarged base, and a push protrusion projecting axially from said enlarged base, said enlarged base extending into said outer drive tube;

the door lock assembly further comprising a limit plate disposed transversely inside outer drive tube and having a central hole for passage of said press button rod, said limit plate being actuated by said press button rod to move to a locking position in which said limit plate projects outwardly from said outer drive tube, wherein said latch-operating tube is rotatable through said inner handle to cause said push protrusion to push said limit plate to an unlocking position in which said limit plate retracts into said outer drive tube.

7. The door lock assembly of claim 4, wherein said cam protrusion projects into said cam groove/slot from an outer surface of said first tubular section.

8. The door lock assembly of claim 1, further comprising a cross plate disposed within said inner drive tube and is moveable to protrude outwardly or inwardly of said inner drive tube, and a spring disposed within said inner drive tube between said cross plate and said press button.

9. The door lock assembly of claim 1, wherein said cam groove/slot has groove end which is turned at an angle with respect to said helical direction to retain said cam protrusion so that said cam protrusion is prevented from sliding undesirably along said cam groove/slot.

10. A door lock assembly comprising:

an inner disc adapted to be fixed to a door;

an inner handle;

a single piece inner drive tube inserted into said inner handle and engaging said inner handle for simultaneous rotation therewith, said inner drive tube extending into said inner disc, and having an outer surface in direct contact with said inner handle;

an inner rotary plate engaging said inner drive tube, and having a central hole;

an outer handle;

an outer drive tube connected to said outer handle;

a latch-operating tube adapted to operate a latch and engaging and passing through said central hole so that rotation of said inner handle can be transmitted to said latch-operating tube through said inner drive tube and said inner rotary plate;

a press button disposed within said inner drive tube and including an outer press end exposed from said inner drive tube;

a cross plate disposed transversely within said inner drive tube and protruding outwardly of said inner drive tube to engage said inner handle;

a cam mechanism associated with said press button and said inner drive tube to rotate said press button when said outer press end is pressed axially, said cam mechanism including an inclined cam groove/slot formed in one of said push button and said inner drive tube and extending in a helical direction, and a cam protrusion formed on the other one of said inner drive tube and said press button and extending into said cam groove/slot so that when said press button is pressed axially, the cam protrusion is always located within the cam groove/slot; and a press button rod extending into said inner drive tube and having one end portion connected to said press button for simultaneous rotation with said press button, said press button rod further extending into said outer drive tube and said latch-operating tube, wherein said press button includes a first tubular section and a second tubular section.

11. The door lock assembly of claim 10, wherein said inclined cam groove/slot has a groove end which is turned at an angle with respect to said helical direction to retain said cam protrusion.

12. The door lock assembly of claim 10, wherein said first tubular section and said second tubular section have said outer press end, said first tubular section having said cam protrusion, said first tubular section further having an axial engaging hole engaging said press button rod so that said press button rod rotates along with said first tubular section.

13. The door lock assembly of claim 12, wherein said press button further includes a shoulder face formed between said first and second tubular sections.

14. The door lock assembly of claim 13, wherein said inner handle has an axial through hole receiving said press button, said shoulder face being engageable with an inner edge of said inner handle around said axial through hole to restrict said first tubular section from moving out of said inner handle, said second tubular section being extendable outward from said axial through hole and having said outer press end.

15. The door lock assembly of claim 10, further comprising a spring disposed within said inner drive tube between said cross plate and said press button to bias said outer press end of said press button to protrude from said inner drive tube.

16. The door lock assembly of claim 1, wherein the press button comprises the first tubular section, a shoulder face formed in the first tubular section, the second tubular section, and a press end cap with an axial hole accommodating the second tubular section.

* * * * *